US007648196B2

(12) United States Patent
Degelman et al.

(10) Patent No.: US 7,648,196 B2
(45) Date of Patent: Jan. 19, 2010

(54) COLLAPSIBLE BENCH OR SEATING WITH CANOPY

(75) Inventors: Scott Degelman, Regina (CA); Perry Senko, Regina (CA)

(73) Assignee: 101149612 Saskatchewan Ltd., Regina, Saskatchewan (CA)

( * ) Notice: Subject to any disclaimer, the term of this patent is extended or adjusted under 35 U.S.C. 154(b) by 110 days.

(21) Appl. No.: 11/909,346

(22) PCT Filed: Mar. 13, 2006

(86) PCT No.: PCT/CA2006/000359

§ 371 (c)(1),
(2), (4) Date: Dec. 21, 2007

(87) PCT Pub. No.: WO2006/099718

PCT Pub. Date: Sep. 28, 2006

(65) Prior Publication Data

US 2009/0140556 A1 Jun. 4, 2009

(30) Foreign Application Priority Data

Mar. 21, 2005 (CA) ..... 2501762

(51) Int. Cl.
*A47C 4/28* (2006.01)
*A47C 7/66* (2006.01)

(52) U.S. Cl. ..... 297/45; 297/184.1; 297/184.11; 297/184.15; 297/248

(58) Field of Classification Search ..... 297/45, 297/232, 233, 248, 184.1, 184.11, 184.12, 297/184.15
See application file for complete search history.

(56) References Cited

U.S. PATENT DOCUMENTS

| | | | | |
|---|---|---|---|---|
| 1,480,286 | A * | 1/1924 | Morganstern | 297/184.11 X |
| 1,738,473 | A * | 12/1929 | Green | 297/45 |
| 2,660,186 | A * | 11/1953 | Marshall et al. | 135/153 |
| 3,243,230 | A * | 3/1966 | Otto | 297/184.15 |
| 4,687,249 | A | 8/1987 | Mills | |
| 4,846,204 | A | 7/1989 | Sok Kyu | |
| 4,865,381 | A * | 9/1989 | Van Rogue | 297/184.15 |
| 5,080,432 | A | 1/1992 | Connell | |
| 5,096,257 | A | 3/1992 | Clark | |

(Continued)

FOREIGN PATENT DOCUMENTS

| | | |
|---|---|---|
| CA | 2225431 | 11/1998 |
| JP | 2002 209663 | 7/2002 |

*Primary Examiner*—Rodney B White
(74) *Attorney, Agent, or Firm*—Daniels Patent Law PLLC; Scott A. Daniels

(57) ABSTRACT

A collapsible bench and canopy has a seat frame made up of a plurality of crossing pairs of seat tubes pivotally connected to each other supporting a fabric seat. A fabric back rest is supported by back tubes attached to the seat frame and a canopy is supported by the back tubes to provide shelter to occupants of the collapsible bench. The bench and canopy can be collapsed in one piece by pivoting down the canopy and ten moving the crossing pairs of seat tubes so that each pair is substantially aligned.

18 Claims, 5 Drawing Sheets

U.S. PATENT DOCUMENTS 5,102,190 A * 4/1992 Akin et al. ..... 297/184.15
5,168,889 A * 12/1992 Diestel ..... 297/184.15 X
5,203,363 A * 4/1993 Kidwell et al. ..... 297/184.15 X
5,240,020 A * 8/1993 Byers ..... 297/184.15 X
5,529,375 A 6/1996 English
5,570,928 A 11/1996 Staunton et al.
5,797,650 A * 8/1998 Gonzalez et al. ..... 297/184.1
5,951,103 A 9/1999 Barnhill
5,967,601 A * 10/1999 Gillins ..... 297/184.15
5,975,626 A 11/1999 Aycock
6,036,262 A * 3/2000 Shahid ..... 297/184.15 X
6,102,479 A * 8/2000 Wallace ..... 297/184.15 X
D432,325 S 10/2000 Zheng et al.
D432,823 S 10/2000 Zheng
6,231,119 B1 5/2001 Zheng
6,247,749 B1 6/2001 Yu
6,296,002 B1 10/2001 Tashchyan
6,354,044 B1 * 3/2002 Lagace, Jr. ..... 297/184.15 X
6,364,410 B1 4/2002 Tang
6,371,553 B1 4/2002 Tang
6,450,161 B1 * 9/2002 Izumi ..... 297/45 X
D468,939 S 1/2003 Zheng
D469,643 S 2/2003 Wu
6,789,557 B1 * 9/2004 Wahl, Jr. ..... 297/184.15 X
6,899,383 B2 5/2005 Hwang
6,925,664 B1 8/2005 Twigg
7,070,230 B2 7/2006 Chen
7,100,221 B1 9/2006 Twigg
7,243,990 B1 * 7/2007 Wahl ..... 297/184.15
7,431,389 B2 * 10/2008 Reeb et al. ..... 297/184.15
7,566,095 B2 * 7/2009 Reeb et al. ..... 297/184.15
7,585,020 B1 * 9/2009 Wahl, Jr. ..... 297/184.15
2004/0207240 A1 * 10/2004 Tondino ..... 297/248
2007/0236058 A1 * 10/2007 Yeider ..... 297/184.1
2009/0218856 A1 * 9/2009 Sykes et al. ..... 297/184.15

* cited by examiner

COLLAPSIBLE BENCH OR SEATING WITH CANOPY

This invention is in the field of equipment portable seating and more particularly in the field of collapsible seating provided with a canopy.

BACKGROUND

There are many situations where a person or group of people would like to sit down and rest where seating is not readily available. It is often convenient to have portable seating that a person can take with them to outdoor events, such as sporting events, concerts, camping, etc. A person can then take their own seat with them and place it where they want. Once they are done with the area, they can simply take the seat with them.

There are numerous prior art collapsible seats that are fairly portable, ranging from the well known aluminum fold up lawn chairs to the more recent collapsible camp chairs. Double chairs provide a pair of seats, convenient for a couple, and can further provide a table between the seats. Examples of such prior art double chairs are disclosed in U.S. Pat. Nos. 5,951,103 to Barnill and 5,529,375 to English. The chair apparatus of U.S. Pat. No. 5,570,928 to Staunton et al. states that it can provide up to four or six chairs side by side, separated by arm rests, connected in a single unit.

U.S. Pat. No. 6,231,119 to Zheng discloses a popular chair construction where the chair frame comprises a plurality of tubes pivotally and slidably attached to each other such that in an expanded seating mode, the tubes are crossed and spread out forward and rearward and laterally at angles to each other to support a fabric cover attached to the frame, and in a collapsed mode the tubes are all substantially aligned to form a compact bundle for transport.

Also, it is often desirable for the portable seat to provide some protection from the elements, such as the sun, wind, or rain. The Barnhill double chair provides a canopy over each chair, and U.S. Pat. No. 5,570,928 to Wildt also includes a canopy over a single chair. U.S. Pat. Nos. 5,096,257 to Clark and 5,080,432 to Connell disclose canopy attachments for folding chairs.

SUMMARY OF THE INVENTION

It is an object of the present invention to provide collapsible bench and canopy apparatus that overcomes problems in the prior art.

The invention provides, in a first embodiment, a collapsible bench and canopy frame apparatus. A seat frame comprises a plurality of pairs of seat tubes, each pair of seat tubes comprising first and second seat tubes pivotally attached to each other at a mid point thereof such that the seat tubes can pivot from a substantially aligned position to a crossed position, and a plurality of upper and lower joint blocks, each joint block pivotally attached to ends of at least two seat tubes. The seat tubes and joint blocks are configured such that the seat frame is movable from a collapsed position, wherein the seat tubes are substantially aligned and adjacent to each other, to a seating position, wherein each pair of seat tubes is in the crossed position and seat spaces are defined between adjacent upper front and rear joint blocks. A back rest frame comprises a substantially vertical back tube extending up from each lower rear joint block slidingly through a corresponding upper rear joint block to a location above the seat frame. A canopy frame comprises at least two vertical canopy tubes, each vertical canopy tube extending upward from a top end of a corresponding back tube, and at least two lateral canopy tubes, each lateral canopy tube pivotally attached at a rear end thereof to a top end of a corresponding vertical canopy tube. The lateral canopy tubes are movable from an extended position, extending forward from top ends of the corresponding vertical canopy tubes, to a collapsed position substantially aligned with the vertical canopy tubes, and a collapsible lateral canopy brace extends between the at least two lateral canopy tubes.

The invention provides, in a second embodiment, a collapsible bench and canopy apparatus. A seat comprises a plurality of pairs of substantially equal length seat tubes, each pair of seat tubes comprising first and second seat tubes pivotally attached to each other at a mid point thereof such that the seat tubes can pivot from a substantially aligned position to a crossed position, and a plurality of upper and lower joint blocks, each joint block pivotally attached to ends of at least two seat tubes. The seat tubes and joint blocks are movable from a collapsed position, wherein the seat tubes are substantially aligned and adjacent to each other, to a seating position, wherein each pair of seat tubes is in the crossed position and seat spaces are defined between adjacent upper front and rear joint blocks. A seat fabric is attached to the upper joint blocks and configured such that the seat fabric is substantially tight when the seat tubes and joint blocks are in the seating position, and such that the seat fabric is folded when the seat tubes and joint blocks are in the collapsed position. A back rest comprises a substantially vertical back tube extending up from each lower rear joint block slidingly through a corresponding upper rear joint block to a location above the seat, and a back rest fabric supported by the vertical back tubes. A canopy comprises at least two vertical canopy tubes, each vertical canopy tube extending upward from a top end of a corresponding back tube, and at least two lateral canopy tubes, each lateral canopy tube pivotally attached at a rear end thereof to a top end of a corresponding vertical canopy tube. The lateral canopy tubes are movable from an extended position, extending forward from top ends of the corresponding vertical canopy tubes, to a collapsed position substantially aligned with the vertical canopy tubes, and a collapsible lateral canopy brace extends between the at least two lateral canopy tubes. A canopy fabric is supported by the lateral canopy tubes.

Because of the orientation of the pairs of crossed seat tubes, there are no cross members running under the width of the fabric seat. This allows a person to comfortably lie across the length of the seat fabric. The back rest provides back support for bench occupants, and the canopy is supported above the bench to provide shelter to occupants of the collapsible bench. A shade flap can be attached to the rear and/or sides of the canopy hanging over the back rest to provide added protection. Similarly an insect net can be provided over top of the canopy to enclose people seated on the collapsible bench to protect them from irritating insects.

The configuration of the collapsible bench and canopy allows the entire apparatus to be collapsed, in one piece, to a relatively compact size to allow the apparatus to be more readily transported and stored than benches of the prior art. Typically, collapsing is readily achieved by a person pushing the front of the collapsible bench towards the rear of the collapsible bench and then pushing one end of the collapsible bench towards the other end of the collapsible bench, or vice versa.

The bench and canopy apparatus of the invention provides convenient portable seating for groups such as families, sports teams, event spectators, and the like. The back rest and shade flap provide large fabric areas where large advertising signs may be placed in view of the passing public, making the bench a good promotional item.

DESCRIPTION OF THESE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
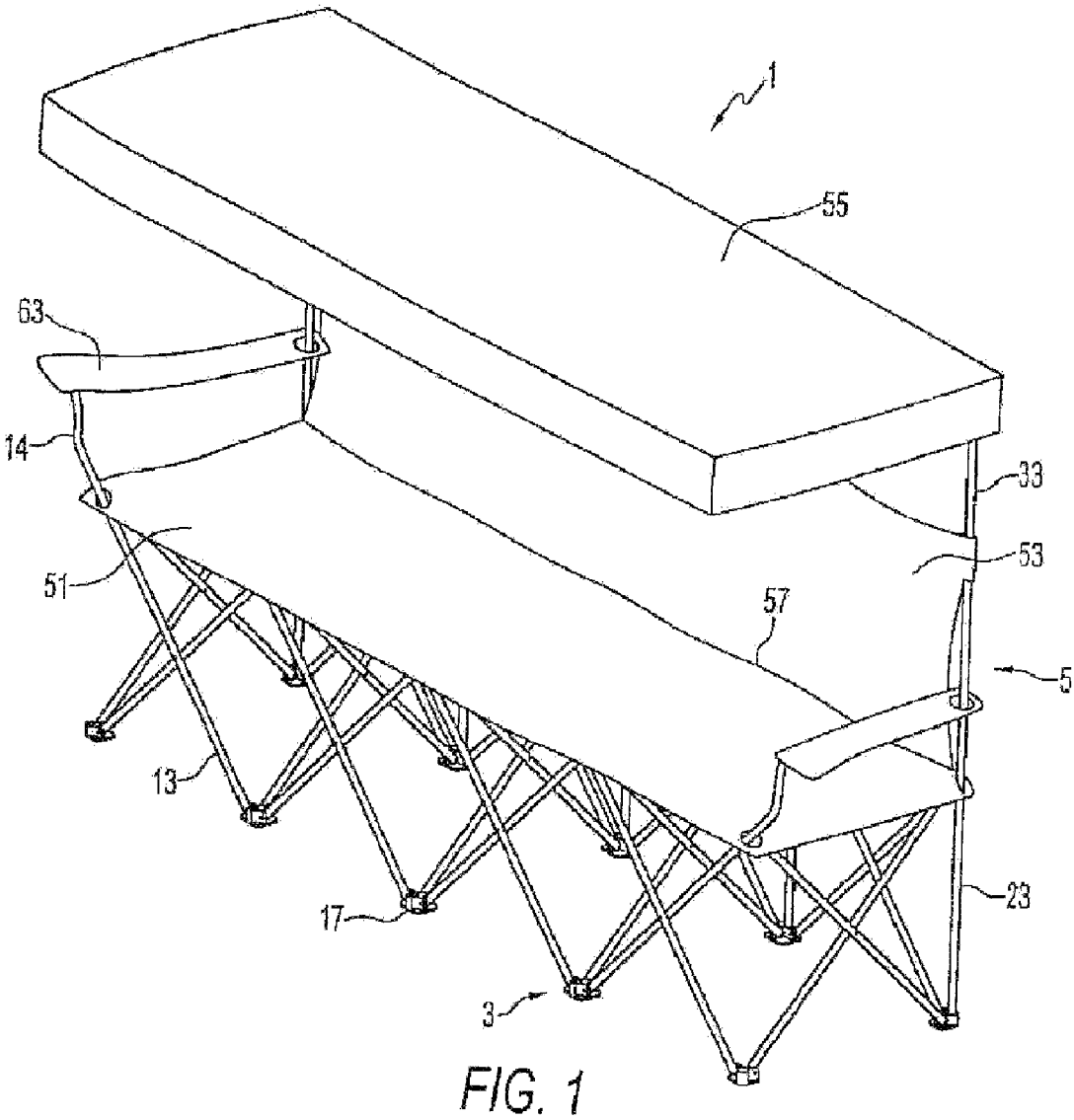
FIG. 1 is a front perspective view of an embodiment of the collapsible bench and canopy apparatus of the present invention in the expanded seating position.
Figure 2:
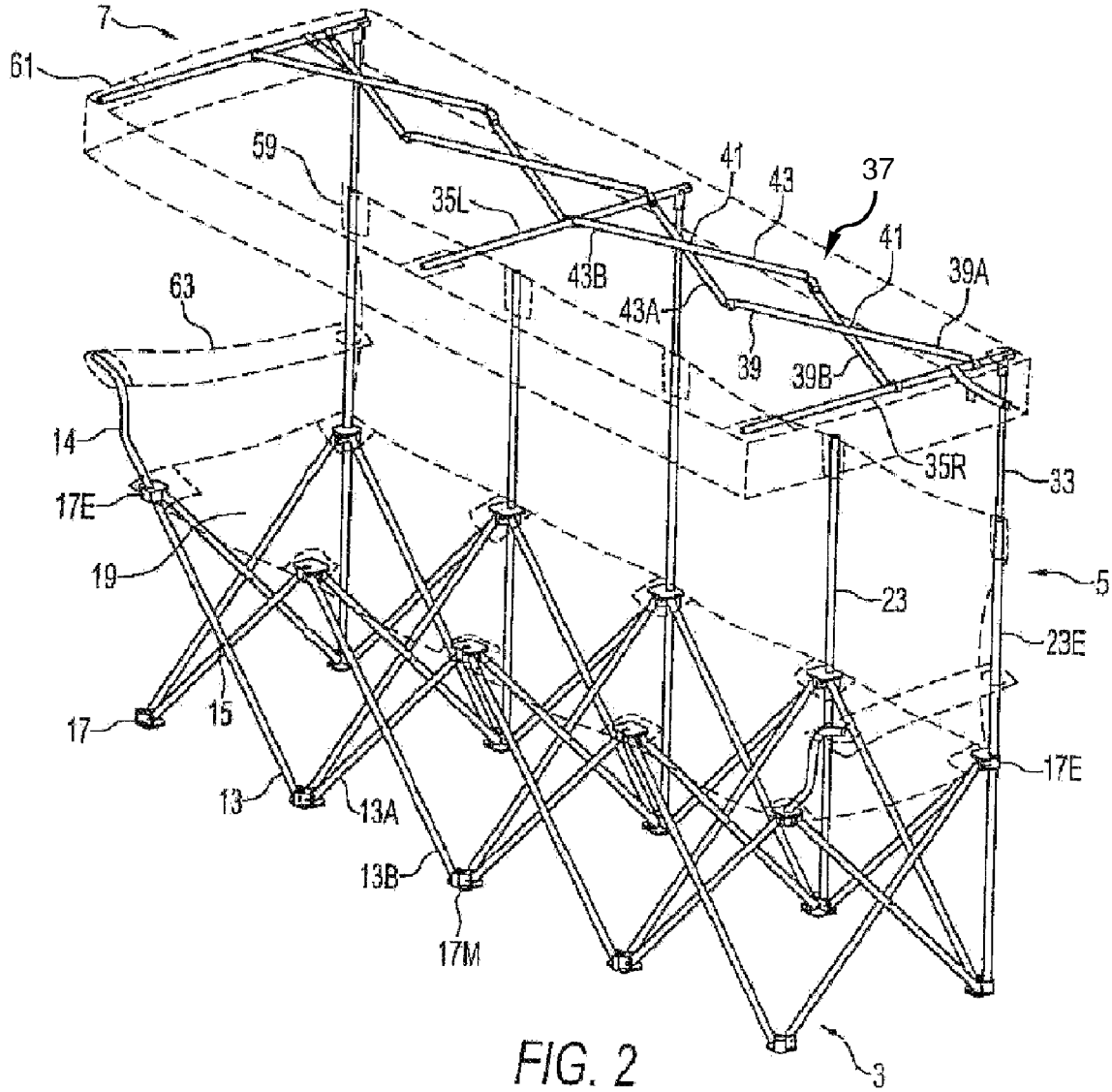
FIG. 2 is a front perspective view of the embodiment of FIG. 1 with the fabric shown in phantom lines to more clearly show the frame of the apparatus.
Figure 3:
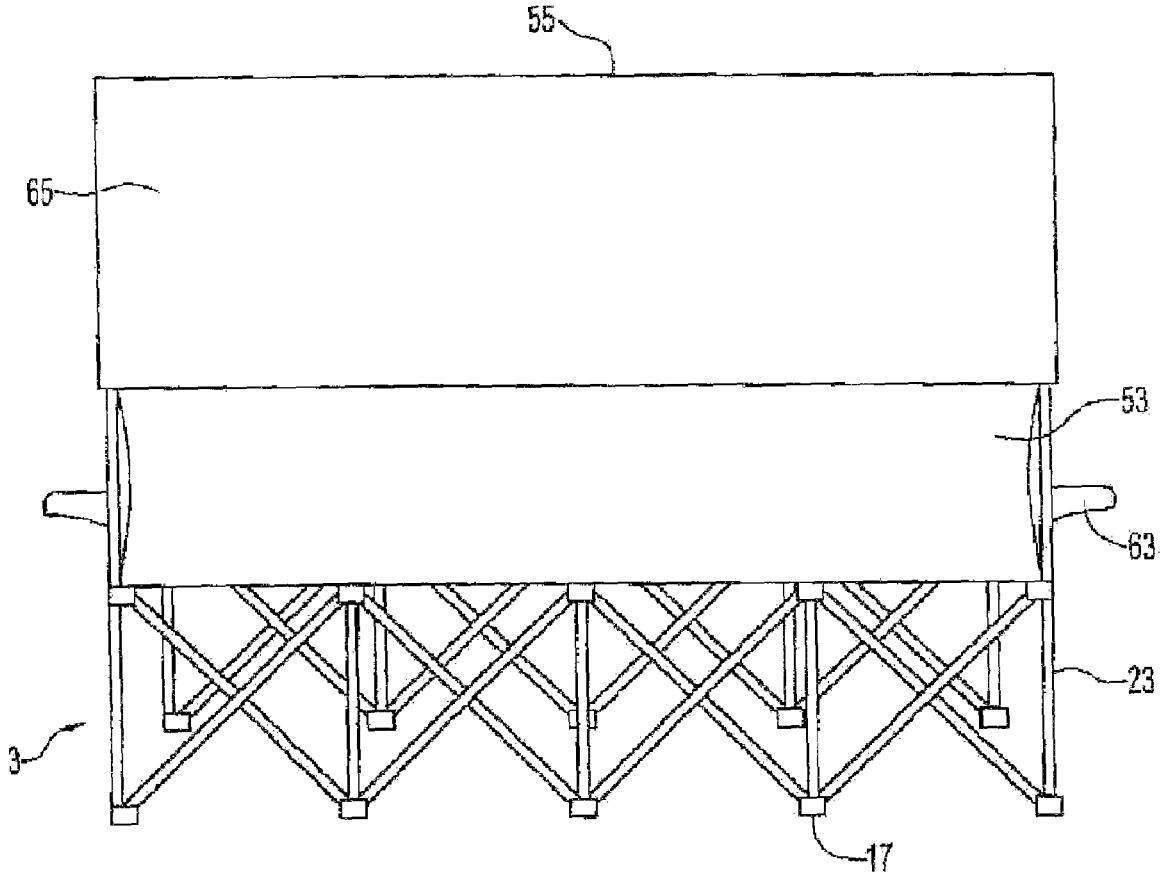
FIG. 3 is a rear view of the embodiment of FIG. 1 with a shade flap attached to provide added protection from the elements.

FIGS. 1-3 illustrate a collapsible bench and canopy apparatus 1 of the invention with a frame 2 comprising a seat frame 3, a back rest frame 5, and a canopy frame 7. FIGS. 4-9 illustrate the frame 2 of the apparatus 1 moving from a partially collapsed lateral position in FIG. 4 to a fully collapsed position in FIG. 9.

The seat frame 3 comprises a plurality of pairs of seat tubes 13. Each pair of seat tubes 13 comprises first and second seat tubes 13A, 13B pivotally attached to each other at a mid point 15 thereof such that the seat tubes 13A, 13B can pivot from a substantially aligned position, illustrated in FIG. 9, to a crossed position illustrated in FIGS. 1-3. Ends of each seat tube 13 are pivotally attached to corresponding upper and lower joint blocks 17. The illustrated seat frame 3 comprises front and rear upper and lower end joint blocks 17E at each end thereof, each pivotally attached to two seat tubes 13, and front and rear upper and lower middle joint blocks 17M at intervals between the ends of the seat frame 3, each pivotally attached to three seat tubes 13.

Each lower front end joint block 17E is pivotally attached to a seat tube 13 extending upward and rearward and is pivotally attached to a seat tube 13 extending upward and toward the opposite end of the seat frame 3, and each upper front end joint block 17E is pivotally attached to a seat tube 13 extending downward and rearward and is pivotally attached to a seat tube 13 extending downward and toward the opposite end of the seat frame.

Each lower front middle joint block 17M is pivotally attached to a seat tube 13 extending upward and rearward and is pivotally attached to a seat tube 13 extending upward and toward the right end of the seat frame 3 and is pivotally attached to a seat tube extending upward and toward the left end of the seat frame 3 Similarly, each upper front middle joint block 17M is pivotally attached to a seat tube 13 extending downward and rearward and is pivotally attached to a seat tube 13 extending downward and toward the right end of the seat frame 3 and is pivotally attached to a seat tube 13 extending downward and toward the left end of the seat frame 3.

Figure 9:
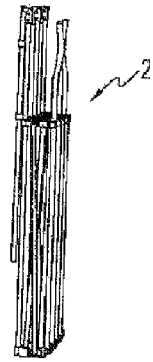

The seat tubes 13 and joint blocks 17 are configured such that the seat frame 3 is movable from a collapsed position illustrated in FIG. 9, wherein the seat tubes 13 are substantially aligned and adjacent to each other, to a seating position illustrated in FIGS. 1-3, wherein each pair of seat tubes 13 is in the crossed position and seat spaces 19 are defined between adjacent upper front and rear joint blocks 17. As illustrated, the seat tubes 13 attached to each joint block 17 are oriented substantially perpendicular to each other when in the crossed position to provide the seat spaces 19.

The seat tube 13E extending downward and toward the opposite end of the seat frame 3 from each upper front end joint block 17E further comprises a tube extension 14 extending upward and outward from the corresponding upper front end joint block 17E and includes an upper end adapted for attachment thereto of an arm rest.

A back rest frame 5 comprises a substantially vertical back tube 23 extending up from each lower rear joint block 17 slidingly through a corresponding upper rear joint block 17 to a location above the seat frame 3 that is suitable for the top of a back support. The upper rear joint blocks 17 can be configured to define a hole that the back tube 23 slides through, or a bracket or the like can be fastened to the joint blocks 17 to slidably engage the back tube 23 and hold the back tube in a substantially vertical orientation with respect to the seat frame 3.

A canopy frame 7 comprises vertical canopy tubes 33 each extending upward from a top end of a corresponding back tube 23. In the illustrated embodiment the vertical canopy tubes 33 telescope in the back tubes 23 to provide a more compact collapsed configuration. The back rest frame 5 comprises right and left end vertical back tubes 23E, and vertical canopy tubes 33 extend upward from a top end of each of the right and left end back tubes 23E and from top ends of alternating back tubes 23 between the right and left end back tubes 23E. The canopy frame 7 is relatively light and is required to support only the weight of a fabric cover, such that vertical canopy tubes 33 are typically only required on alternating back tubes 23.

Lateral canopy tubes 35 are pivotally attached at rear ends thereof to top ends of corresponding vertical canopy tubes 33. The lateral canopy tubes 35 are movable from an extended position illustrated in FIGS. 1-3, resting on a stop such that they extend forward from top ends of the corresponding vertical canopy tubes 33, upward to intermediate positions illustrated in FIGS. 5-7, and then downward to the collapsed position substantially aligned with the vertical canopy tubes 33 as illustrated in FIGS. 8 and 9.

A collapsible lateral canopy brace 37 extends between the lateral canopy tubes 35. The illustrated lateral canopy brace 37 comprises a scissor assembly attached at each end thereof to one of the lateral canopy tubes 35. A pair of right scissor legs 39 are pivotally attached at mid-points 41 thereof. The inside end of one right scissor leg 39A is fixed to a right lateral canopy tube 35R and an inside end of the other right scissor leg 39B is slidingly engaged on the right lateral canopy tube 35R. At the opposite end of the brace 37 a pair of left scissor legs 43 are pivotally attached at mid-points 41 thereof. The inside end of one left scissor leg 43A is fixed to a left lateral canopy tube 35L and the inside end of the other left scissor leg 43B is slidingly engaged on the left lateral canopy tube 35L. Outside ends of the right scissor legs 39 are pivotally attached to corresponding outside ends of the left scissor legs 43 such that the scissor legs 39, 43 can move from a collapsed position illustrated in FIG. 9, where the scissor legs 39, 43 and lateral canopy tubes 35 are substantially aligned and adjacent to each other, to a crossed position illustrated in FIGS. 1-3 to maintain the lateral canopy tubes 35 in die proper position to support a canopy fabric.

Figure 4:
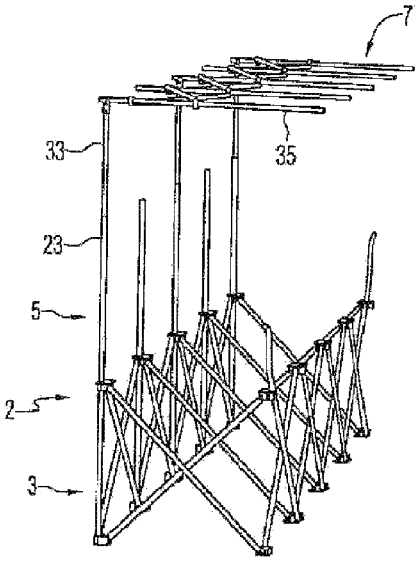
FIGS. 4-9 are side perspective views of the frame of the embodiment of FIG. 1 moving to the collapsed position.
Figure 5:
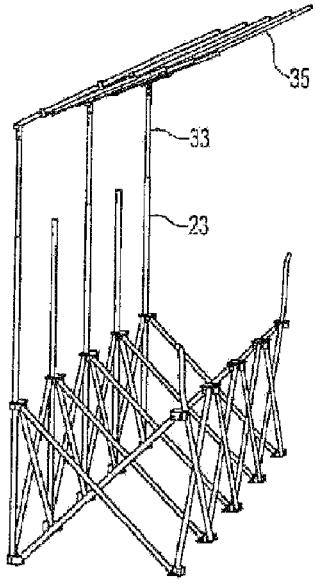
Figure 6:
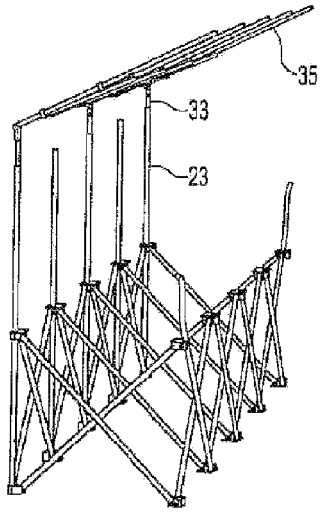
Figure 7:
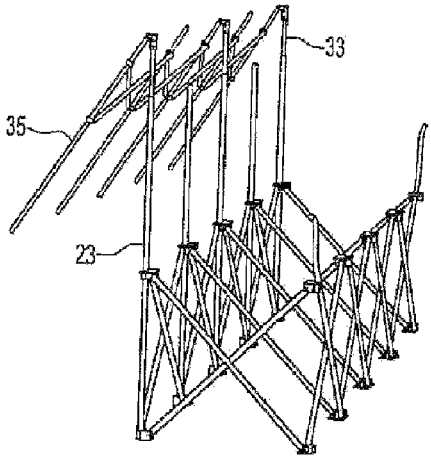
Figure 8:
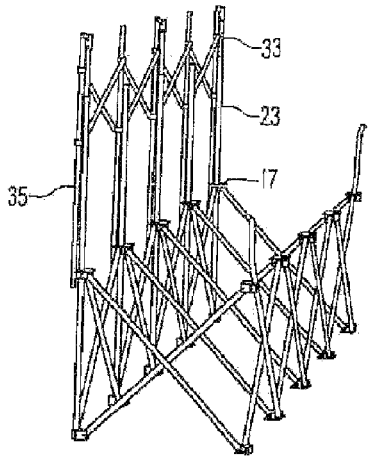

FIGS. 4-9 illustrate the frame 2 comprising seat frame 3, back rest frame 5, and canopy frame 7 moving to the collapsed position. FIG. 4 shows the frame 2 with ends thereof partially moved toward each other compared to the seating position of FIGS. 1-3. In FIG. 5 the lateral canopy tubes 35 are shown partially raised to illustrated the direction of movement in the illustrated embodiment. FIG. 6 shows the vertical canopy tubes 35 telescoped down into the back tubes 23. FIGS. 7 and 8 show the movement of the lateral canopy tubes 35 over and down into alignment with the vertical canopy tubes 33 and back tubes 23. FIG. 9 shows the frame 2 with die ends pushed together and the front side pushed toward the rear side into the collapsed position. As the front is pushed rearward, the upper rear joint blocks 17 slide up the back tubes 23.

To complete the bench and canopy apparatus, fabric is attached to the frames. A seat fabric 51, back rest fabric 53, and canopy fabric 55 are configured such that the fabrics 51, 53, 55 are substantially tight when the seat tubes 13 and joint blocks 17 are in the seating position, as illustrated in FIG. 1. In the illustrated embodiment the rear edge of the seat fabric 51 is connected to the bottom edge of the back rest fabric 53 along a seam 57.

The seat fabric 53 is sewn around the upper joint blocks 17 or otherwise connected as is known in the art. Conveniently back pockets 59 are defined by an upper portion of the back rest fabric 53 and upper ends of the vertical back tubes 23 are located inside the back pockets 59. Similarly canopy pockets 61 are defined by a front portion of the canopy fabric 55 and front ends of the lateral canopy tubes 35 are located inside the canopy pockets 61. An arm rest fabric 63 is attached by a pocket to the tube extensions 14 and the end back tubes 23E.

FIGS. 1 and 2 show an embodiment wherein the canopy fabric 55 extends downward along the vertical canopy tubes 33 to a location above the back rest fabric, while FIG. 3 shows an embodiment wherein the canopy fabric 55 extends downward to a location below a top edge of the back rest fabric 53, thereby providing added shelter from sun and wind. Conveniently the canopy of FIG. 3 can be provided by attaching a shade flap 65 to the canopy of FIGS. 1 and 2 with hook and loop fasteners, zippers, or the like. Similar side flaps can be provided as well, or mosquito netting can be provided that hangs down from the canopy to protect occupants of the bench from irritating insects.

The fabrics 51, 53, 55, and 63 fold when the frame 2 is moved toward the collapsed position of FIG. 9. With the fabrics installed on the frame 2, the tubes are not able to move all the way to the collapsed position because the fabric must lie between the tubes, however a compact readily transportable bundle is attained. A bag or ties can be provided to maintain the apparatus 1 in the collapsed state for convenient transport.

The illustrated embodiment of the collapsible bench and canopy apparatus 1 provides seating for four people but the number of seats can be increased to any practical amount. The illustrated four seat apparatus 1 also provides a convenient bench for a person to lie down on. The configuration is such that there are no arm rests between the ends of the bench apparatus 1, and further there are no tubes extending between the upper front and rear joint blocks so that the seat fabric 51 is supported only at front and rear edges thereof. The seat fabric 51 can thus move downward to comfortably conform to the body of a person lying across the seat spaces 9.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A collapsible bench and canopy frame apparatus comprising:

a seat frame comprising:

a plurality of pairs of seat tubes, each pair of seat tubes comprising first and second seat tubes pivotally attached to each other at a mid point thereof such that the seat tubes can pivot from a substantially aligned position to a crossed position;

a plurality of upper and lower joint blocks, each joint block pivotally attached to ends of at least two seat tubes;

wherein the seat tubes and joint blocks are configured such that the seat frame is movable from a collapsed position, wherein the seat tubes are substantially aligned and adjacent to each other, to a seating position, wherein each pair of seat tubes is in the crossed position and seat spaces are defined between adjacent upper front and rear joint blocks, wherein the seat frame forms a support for a fabric seat defining at least three seating positions for accommodating at least three persons in a conventional seated posture;

a back rest frame comprising:

a substantially vertical back tube extending up from each lower rear joint block slidingly through a corresponding upper rear joint block to a location above the seat frame; and a canopy frame comprising;

at least two vertical canopy tubes, each vertical canopy tube concentrically slidably arranged within a corresponding back tube and extending telescopically upward from an open top end of the corresponding back tube;

at least two lateral canopy tubes, each lateral canopy tube pivotally attached at a rear end thereof to a top end of a corresponding vertical canopy tube, wherein the lateral canopy tubes are movable from an extended position, extending forward from top ends of the corresponding vertical canopy tubes, to a collapsed position substantially aligned with the vertical canopy tubes; and a collapsible lateral canopy brace extending between the at least two lateral canopy tubes.

2. The apparatus of claim 1, wherein the seat frame comprises front and rear upper and lower end joint blocks at each end thereof, each upper and lower end joint block pivotally attached to two seat tubes, and comprises front and rear upper and lower middle joint blocks at intervals between the ends thereof, each upper and lower middle joint block pivotally attached to three seat tubes.

3. The apparatus of claim 2, wherein seat tubes attached to each joint block are oriented substantially perpendicular to each other when in the crossed position.

4. The apparatus of claim 2, wherein each lower front end joint block is pivotally attached to a seat tube extending upward and rearward and is pivotally attached to a seat tube extending upward and toward the opposite end of the seat frame, and wherein each upper front end joint block is pivotally attached to a seat tube extending downward and rearward and is pivotally attached to a seat tube extending downward and toward the opposite end of the seat frame.

5. The apparatus of claim 4, wherein each lower front middle joint block is pivotally attached to a seat tube extending upward and rearward and is pivotally attached to a seat tube extending upward and toward a first end of the seat frame and is pivotally attached to a seat tube extending upward and toward a second end of the seat frame, and wherein each upper front middle joint block is pivotally attached to a seat tube extending downward and rearward and is pivotally attached to a seat tube extending downward and toward the first end of the seat frame and is pivotally attached to a seat tube extending downward and toward the second end of the seat frame.

6. The apparatus of claim 4, wherein the seat tube extending downward and toward the opposite end of the seat frame from each upper front end joint block further comprises a tube extension extending upward and outward from the corresponding upper front end joint block and includes an upper end adapted for attachment thereto of an arm rest fabric.

7. The apparatus of claim 1, wherein the lateral canopy brace comprises a scissor assembly attached at each end thereof to one of the at least two lateral canopy tubes.

8. The apparatus of claim 7, wherein the scissor assembly comprises:

a pair of right scissor legs pivotally attached at mid-points thereof, an inside end of one right scissor leg fixed to a right lateral canopy tube and an inside end of the other right scissor leg slidingly engaged on the right lateral canopy tube; and a pair of left scissor legs pivotally attached at mid-points thereof, an inside end of one left scissor leg fixed to a left lateral canopy tube and an inside end of the other left scissor leg slidingly engaged on the left lateral canopy tube;

wherein outside ends of the right scissor legs are pivotally attached to corresponding outside ends of the left scissor legs, such that the scissor legs can move from a collapsed position wherein the scissor legs and lateral canopy tubes are substantially aligned and adjacent to each other, to a crossed position.

9. The apparatus of claim 1, wherein the back rest frame comprises right and left end vertical back tubes, and the corresponding concentrically arranged vertical canopy tubes telescopically extend upward from the top end of each of the right and left end back tubes and a canopy extends entirely over the fabric seat.

10. The apparatus of claim 9, wherein the back rest frame comprises a vertical canopy tube extending upward from a top end of alternating back tubes between the right and left end back tubes.

11. The apparatus of claim 9, wherein the canopy extends entirely over the fabric seat in a substantially parallel planar arrangement with the fabric seat when the collapsible bench is in a completely extended position.

12. A collapsible bench and canopy apparatus comprising:

a seat comprising:

a plurality of pairs of substantially equal length seat tubes, each pair of seat tubes comprising first and second seat tubes pivotally attached to each other at a mid point thereof such that the seat tubes can pivot from a substantially aligned position to a crossed position;

a plurality of upper and lower joint blocks, each joint block pivotally attached to ends of at least two seat tubes;

wherein the seat tubes and joint blocks are movable from a collapsed position, wherein the seat tubes are substantially aligned and adjacent to each other, to a seating position, wherein each pair of seat tubes is in the crossed position and seat spaces are defined between adjacent upper front and rear joint blocks;

the seat spaces defining at least three seating positions for accommodating at least three persons in a conventional seated posture;

a seat fabric attached to the upper joint blocks and configured such that the seat fabric is substantially tight when the seat tubes and joint blocks are in the seating position, and such that the seat fabric is folded when the seat tubes and joint blocks are in the collapsed position;

a back rest comprising:

a substantially vertical back tube extending up from each lower rear joint block slidingly through a corresponding upper rear joint block to a location above the seat, and a back rest fabric supported by the vertical back tubes; and a canopy comprising;

at least two vertical canopy tubes, each vertical canopy tube concentrically slidably arranged within a corresponding back tube and extending telescopically upward from an open top end of the corresponding back tube;

at least two lateral canopy tubes, each lateral canopy tube pivotally attached at a rear end thereof to a top end of a corresponding vertical canopy tube, wherein the lateral canopy tubes are movable from an extended position, extending forward from top ends of the corresponding vertical canopy tubes, to a collapsed position substantially aligned with the vertical canopy tubes;

a collapsible lateral canopy brace extending between the at least two lateral canopy tubes; and wherein the corresponding concentrically arranged vertical canopy tubes telescopically extend upward from the top end of each of the right and left end back tubes and a canopy fabric supported by the lateral canopy tubes extends entirely over the fabric seat in a substantially parallel planar arrangement with the fabric seat when the collapsible bench is completely extended in the seating position.

13. The apparatus of claim 12, wherein a rear edge of the seat fabric is connected to a bottom edge of the back rest fabric.

14. The apparatus of claim 13, comprising back pockets defined by an upper portion of the back rest fabric and wherein upper ends of the vertical back tubes are located inside the back pockets.

15. The apparatus of claim 12, comprising canopy pockets defined by a front portion of the canopy fabric and wherein front ends of the lateral canopy tubes are located inside the canopy pockets.

16. The apparatus of claim 12, wherein the canopy fabric extends downward along the vertical canopy tubes to a location above the back rest fabric.

17. The apparatus of claim 12, wherein the canopy fabric extends downward along the vertical canopy tubes and vertical back tubes to a location below the top edge of the back rest fabric.

18. The apparatus of claim 12, comprising an outer seat tube including a tube extension, the outer seat tube extending downward and toward a left end of the seat from an upper front right end joint block and the tube extension extending upward and outward from the upper front right end joint block, and an arm rest fabric attached to a top end of the tube extension and attached to a corresponding right end vertical back tube.

* * * * *